US009451827B1

(12) United States Patent
Ciraolo

(10) Patent No.: US 9,451,827 B1
(45) Date of Patent: Sep. 27, 2016

(54) VANDAL RESISTANT SAFETY SWING SEAT

(71) Applicant: Charles Ciraolo, Santee, CA (US)

(72) Inventor: Charles Ciraolo, Santee, CA (US)

( * ) Notice: Subject to any disclaimer, the term of this patent is extended or adjusted under 35 U.S.C. 154(b) by 0 days.

(21) Appl. No.: 14/630,490

(22) Filed: Feb. 24, 2015

(51) Int. Cl.
*A47C 5/00* (2006.01)
*A47C 3/025* (2006.01)
*A47C 5/12* (2006.01)

(52) U.S. Cl.
CPC ..... *A47C 3/0255* (2013.01); *A47C 5/00* (2013.01); *A47C 5/12* (2013.01)

(58) Field of Classification Search
CPC ..... A47C 3/0255
See application file for complete search history.

(56) References Cited

U.S. PATENT DOCUMENTS 1,975,262 A * 10/1934 Evans ..... A47D 13/105 182/222
5,575,073 A * 11/1996 von Wedemayer .. G01C 15/008 33/285

* cited by examiner

*Primary Examiner* — Michael Dennis
(74) *Attorney, Agent, or Firm* — Palomar Patent; Calif Tervo

(57) ABSTRACT

A vandal resistant swing seat generally comprises a tension member and a rubber cover. The tension member comprises a body connected to end connectors that attach to suspension chains. The body includes a tension component comprising an elongate fabric band having a front edge having a fold, and a rear edge having a fold, and a protection component comprising a metal cable disposed in each fold. The flexible metal wires prevent the tension fabric from being cut. In an alternate embodiment, the fabric band is comprised of a central mesh band of a first fabric and front and rear edge bands of a second fabric of higher tensile strength.

2 Claims, 6 Drawing Sheets

VANDAL RESISTANT SAFETY SWING SEAT

FIELD OF THE INVENTION

This invention relates generally to a seat for a child's swing, and more specifically to a swing seat that is resistant to vandalism without sacrificing other desirable properties.

BACKGROUND OF THE INVENTION

Many public playgrounds include swings. It is desirable that a swing seat is light in weight and not rigid so as to not cause serious injury should one strike a child. A flexible seat conforms to the body of the user and helps retain the user in the seat during use.

However, public swing seats are often vandalized and destroyed, typically by cutting into the front or rear edge of the seat. A recent approach to prevent vandalism and closely retain other seat desirable properties has been to make the internal tension member of a sheet of metal. The metal sheet is flexible in one direction so as to conform to the user's body and resists cutting.

One problem with a metal sheet insert is that, if its edge is exposed by vandalism, the exposed edge becomes a dangerous cutting element that can easily harm a child.

Therefore, there is a need for an improved swing seat that resists vandalism without introducing additional danger to the users by being heavier or exposing cutting edges.

SUMMARY OF THE INVENTION

The invention is a vandal resistant swing seat and it generally comprises a tension member and a rubber cover for sitting upon by a user. The tension member comprises a body and end connectors. The body includes a tension component and a protection component. In an exemplary embodiment the tension component of the body comprises an elongate fabric band having a left end; a right end, a front edge having a fold, and a rear edge having a fold, and a protection component comprises a front elongate metal cable disposed in the front fold and a rear elongate cable disposed in the rear fold. The fabric band is comprised of a central band of a first fabric and front and rear edge bands of a second fabric of higher tensile strength connected to the front and rear edges of the central band. In an exemplary embodiment, the central band is a mesh. Each end of the fabric band is attached to an end connector for connection to a suspension chain. The flexible metal wires prevent the tension fabric from being cut.

Other features and many attendant advantages of the invention will become more apparent upon a reading of the following detailed description together with the drawings wherein like reference numerals refer to like parts throughout.

DETAILED DESCRIPTION OF THE INVENTION

Figure 1:
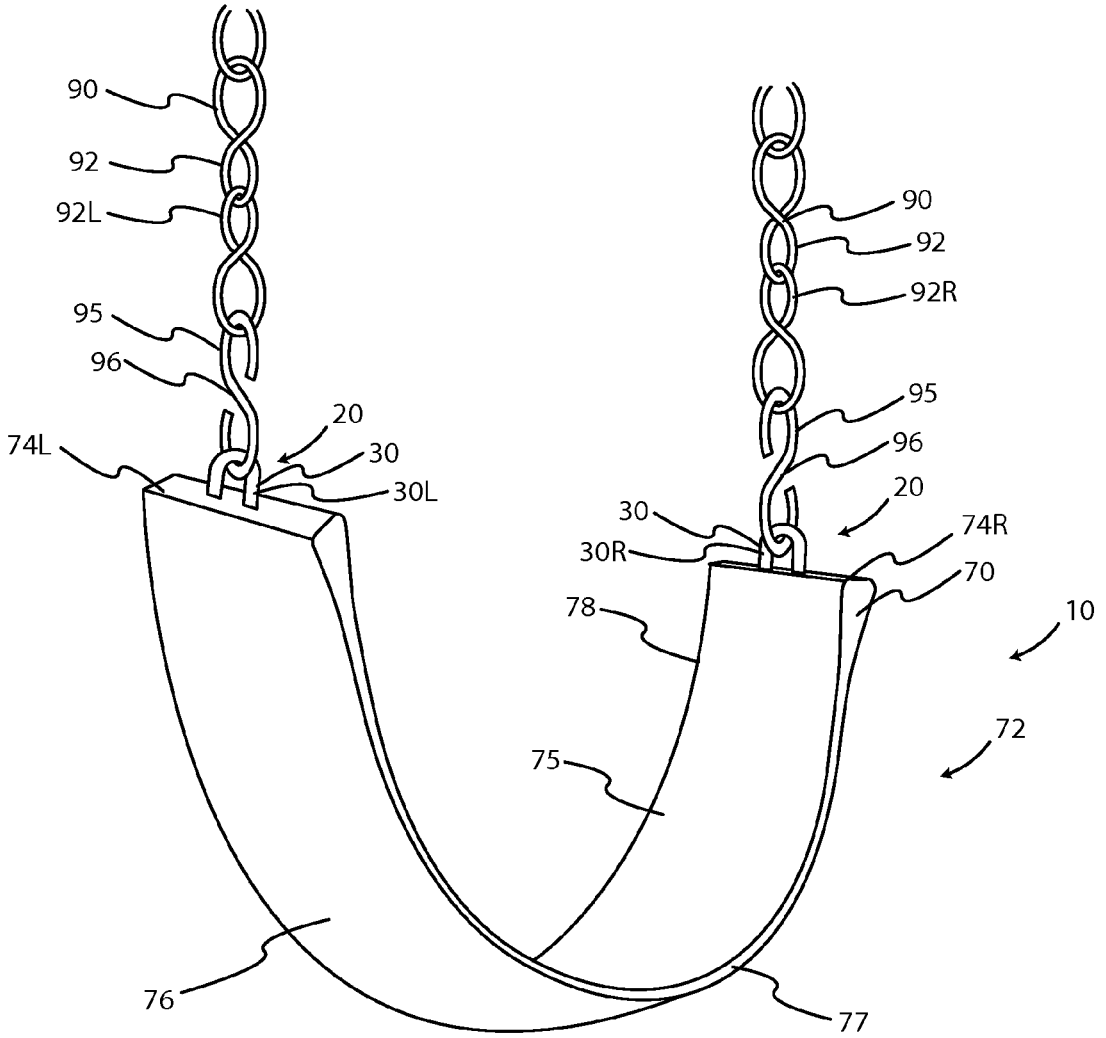
FIG. 1 is a left, front perspective view of an exemplary embodiment of the vandal resistant safety swing seat of the invention in a typical suspended position.

With initial reference to FIG. 1 of the drawings, there is shown a left, front perspective view of an exemplary embodiment of the vandal resistant safety swing seat, denoted generally as 10, of the invention in a typical suspended position suspended by a pair of suspending elements 90, such as elongate, flexible, tension members, such as chains 92, such as left and right chains 92L, 92R, from a suspending structure (not shown), such as a elevated frame, swing set, tree limb, etc.

Chains 92 are conventional and allow seat 10 to hang freely from a suspending structure and provide graspable handles for use by an occupant, such a child, when swinging. Although chains 92 are shown, suspending elements 90 may be cables, ropes, or other elements as are known in the art. Joining members 95 join seat 10 to chains 92. Joining members 95 may be S-links 96, as shown, locking links, closable chain links, or other suitable members, as are known in the art.

Seat 10 generally includes: a resilient cover 70 covering a tension member 20. Resilient cover 70 includes an elongate seating member 72 including a left end 74L, an opposite right end 74R; a top face 75 and an opposite bottom face 76; a front face 77, and an opposite rear face 78. The only parts of tension member 20 that can be seen in FIG. 1 are a pair of end connectors 30, such as left end connector 30L projecting from left end 74 of resilient cover 70 and right end connector 30R projecting from right end 76 of resilient cover 70. End connectors 30L, 30R connect seat 10 to chains 92L and 92R, respectively. As shown in FIG. 1, seat 10 is adapted to bend under the weight of an occupant and/or under it own weight so as to generally conform to the body of the occupant. Common dimensions for seat 10 would be: length of 27-30" and width of 5-6.5".

Figure 2:
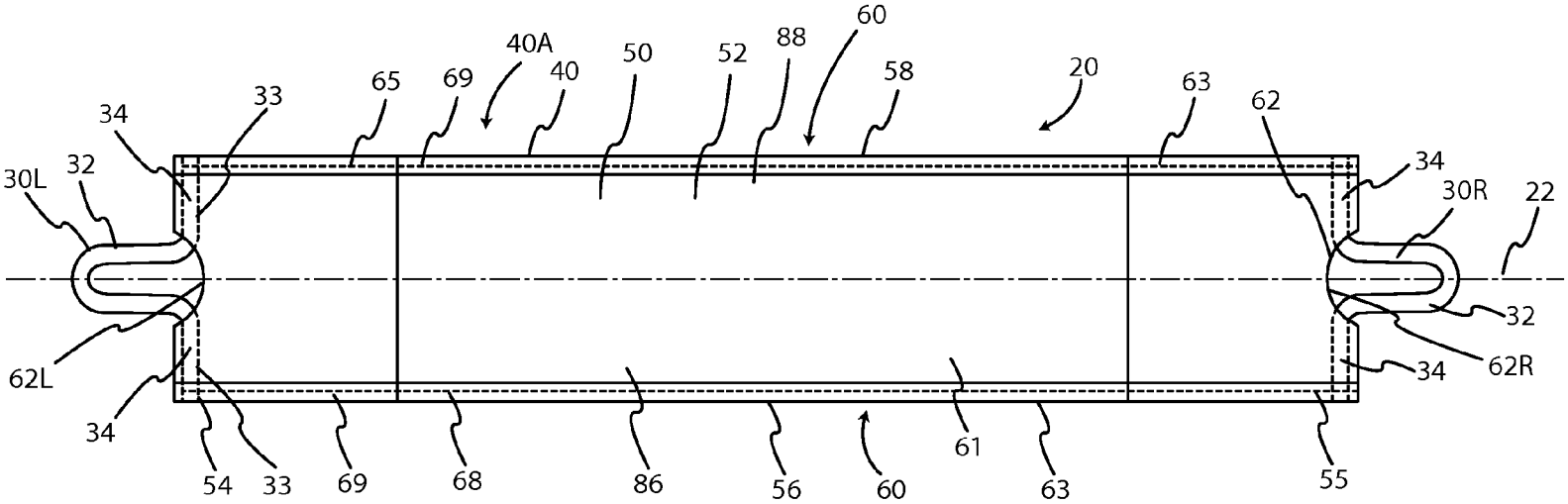
FIG. 2 is a top plan view of the tension member insert.
Figure 3:
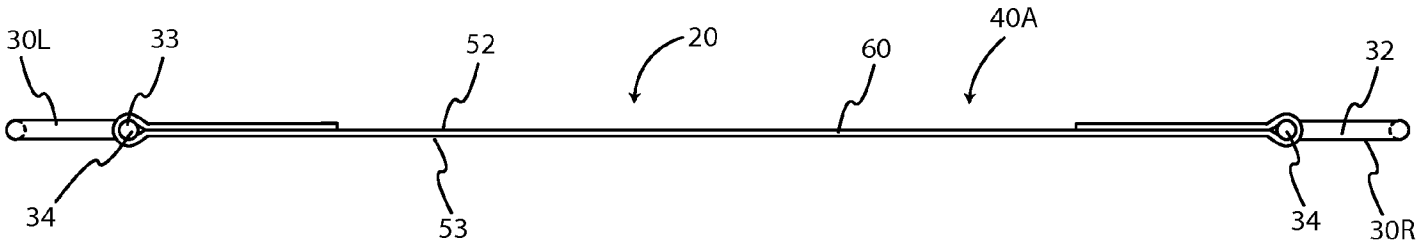
FIG. 3 is front elevation view of the insert of FIG. 2, the rear elevation view being a mirror image.
Figure 4:
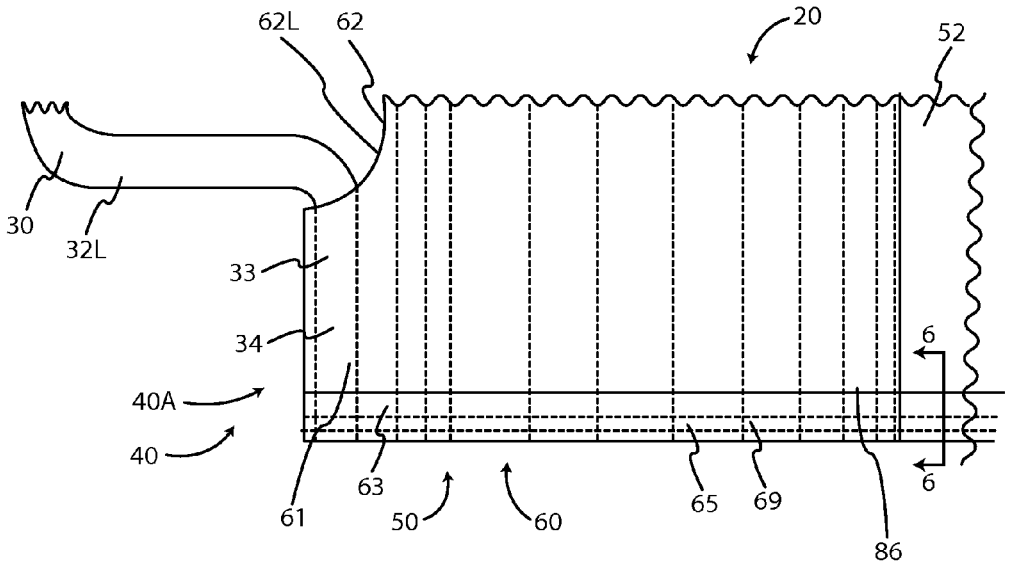
FIG. 4 is an enlarged top view of an end portion of the insert of FIG. 2.
Figure 5:
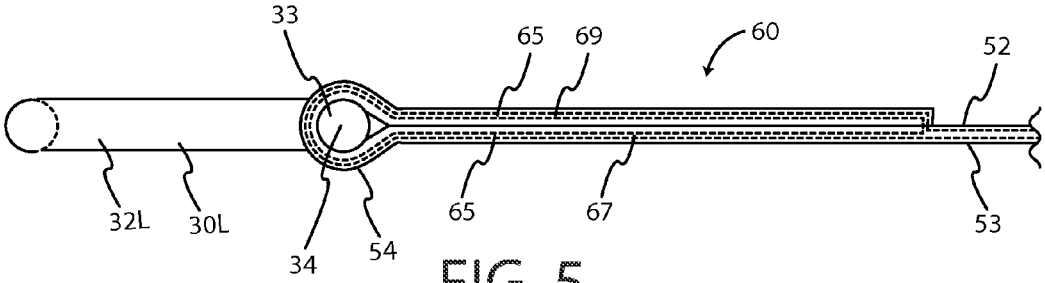
FIG. 5 is a front elevation view of the end portion of FIG. 4.
Figure 6:
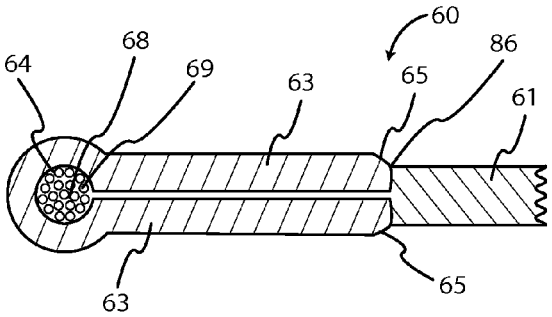
FIG. 6 is a sectional view taken on line 6-6 of FIG. 4.

FIGS. 2-6 are views of tension member 20 that is connected to suspending elements 90 and is the major load-carrying member of seat 10. FIG. 2 is a top plan view of tension member 20. FIG. 3 is front elevation view of tension member 20 of FIG. 2. The rear elevation view is a mirror image. FIG. 4 is an enlarged top view of an end portion of the tension member 20 of FIG. 2. FIG. 5 is a front plan view of the end portion of FIG. 4. FIG. 6 is a sectional view taken on line 6-6 of FIG. 4.

Tension member 20 has a longitudinal axis 22 and generally comprises end connectors 30L, 30R and an elongate, flexible, strap-like body 40 spanning between end connectors 30L, 30R. In the exemplary embodiment, each end connector 30 is a capital-omega-shaped element made of strong, non-corrosive material, such as stainless steel, and having an outer connection means, such as bight 32, and an inner connection means, such as attachment portion 33, such as two ends 34. End connector 30 may be a T-302 stainless steel ⅜" diameter rod bent to shape. Suspending elements 90 connect to outwardly protruding bight 32 for suspending seat 10. Body 40 connects to ends 34.

Body 40 generally comprises a tension component 50 and a protection component 68. Tension component 50 includes: a top face 52; a bottom face 53, opposite; a left end 54; a right end 55, opposite; a front edge 56; and a rear edge 58, opposite. In the first exemplary embodiment 40A of body 40, tension component 50 further includes a fabric band 60 including, longitudinally, a central section 61 of first fabric of low tensile strength material, such as polyester fabric, and edge bands 63 of a second material of very high tensile strength fabric, such as a aramid synthetic fiber, such as DuPont Kevlar at front and rear edges 56, 58.

As best seen in FIG. 6, each high strength band 63 is folded to form an edge fold 64 and the inner, free edges 65 are attached to the front 86 and rear edges 88 of central section 61 in a suitable manner, such as by weaving them together. Protection component 68 is an elongate flexible metal component that resists cutting. In the exemplary embodiment, protection component is a pair of 19 strand, 0.031" diameter, T-302 stainless steel cables 69. A cable 69 is held in edge fold 64 of each high strength band 63 such as by being woven into fold 64, such as by one of the fabrics. Glancing back at FIG. 2, a front cable 69 can be seen in phantom disposed in the fold 64 of front bands 63 near front edge 56 and a rear cable 69 can be seen in phantom near rear edge 58 over the length of fabric band 60.

Figure 10:
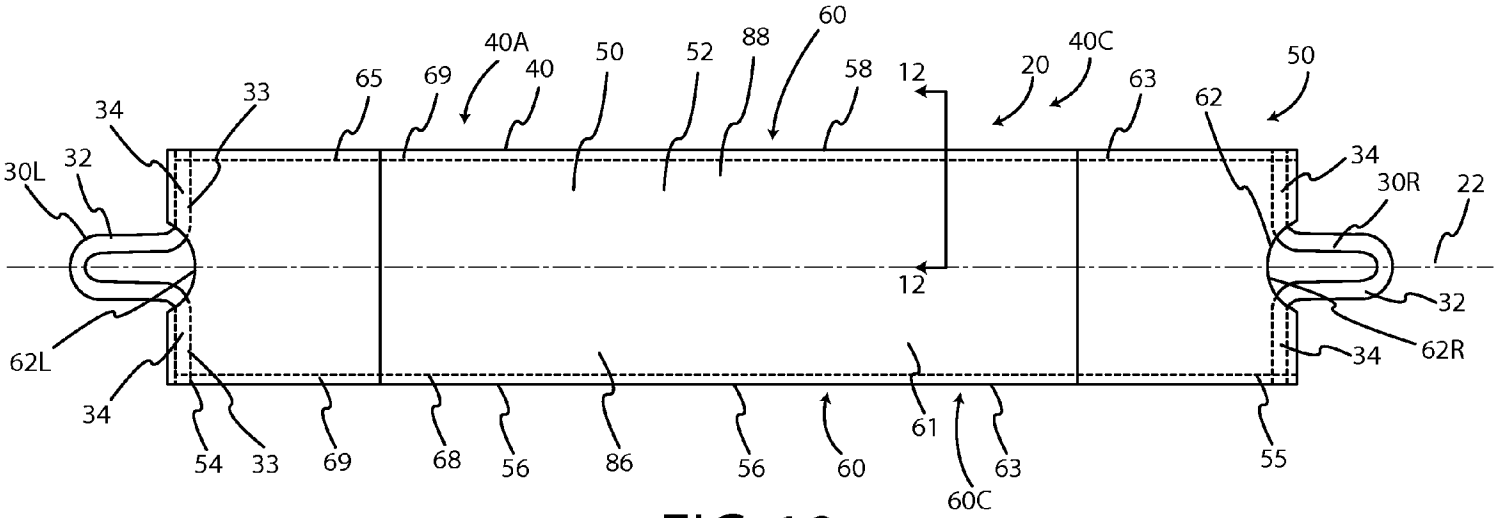
FIG. 10 is a top plan view of a third embodiment of the tension member insert.

As seen in FIGS. 2, 4, and 10, cutouts 62 in body 40 aid in attaching body 40 to end connectors 30. At left end 54 of body 40 is cutout 62L in central section 61 for receiving bight 32 of left end connector 30L. At left end 54 of body 40, body 40 is folded over ends 34 of end connector 30L, such that ends 34 of connector 30L are in the fold and bight 32 protrudes. The folded back portion of body 40 is attached to the reminder of body 40 such as by sewing or weaving. At right end 55 of body 40 is a cutout 62R for receiving bight 32 of right end connector 30R. At right end 55 of body 40, body 40 is folded over ends 34 of end connector 30R, such that ends 34 of connector 30R are in the fold and bight 32 protrudes. The folded back portion of body 40 is attached to the reminder of body 40 such as by sewing or weaving. Central section 61 provides for separation of edge bands 63 and a surface for attachment of cover 70, as seen in FIG. 10.

FIGS. 2 and 3 show complete tension member 20. A tension member made in this manner with DuPont Kevlar K-29 as front and rear end bands 63 tested at over 2,700 pounds tensile strength. Cable 69 embedded in the edge folds 64 prevents or deters cutting of body 40 from the front or rear edge 56, 58 and also adds some tensile strength.

Figure 7:
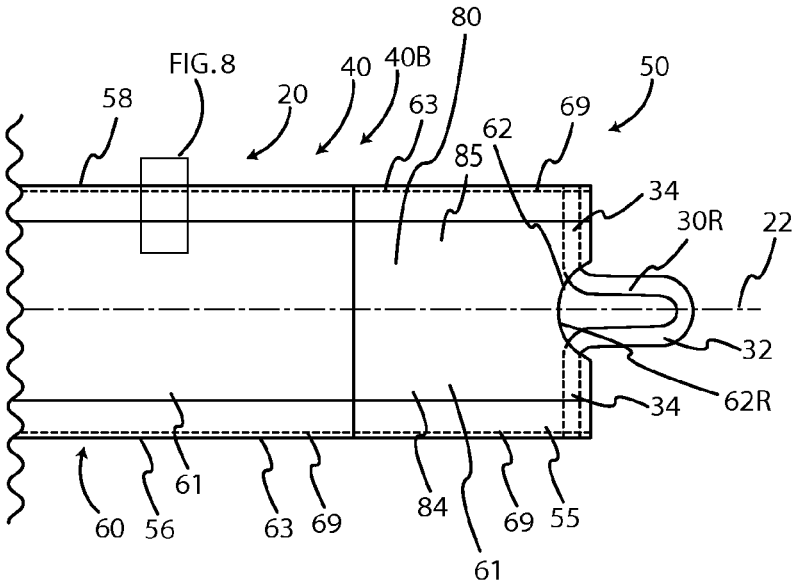
FIG. 7 is a top plan view, partially cut away, of a second embodiment of the tension member insert.
Figure 8:
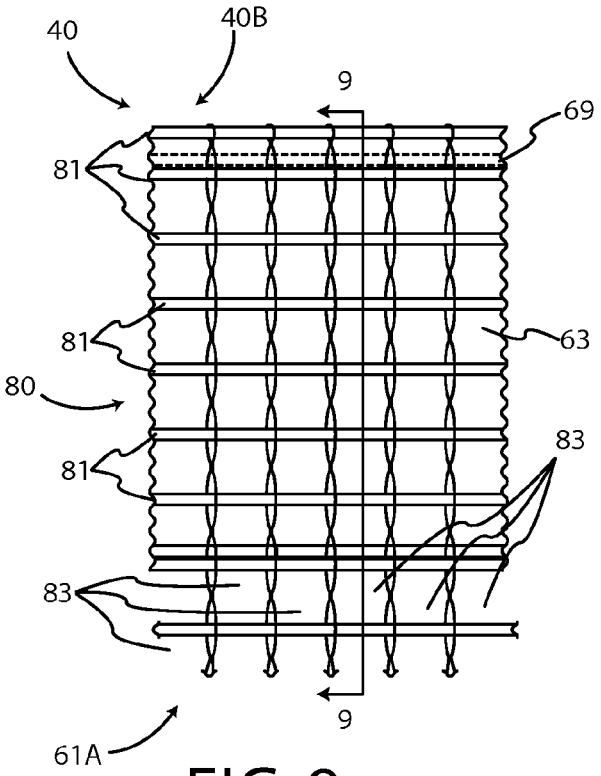
FIG. 8 is an enlarged top plan view, partially cut away, of the area 8 of FIG. 7.
Figure 9:
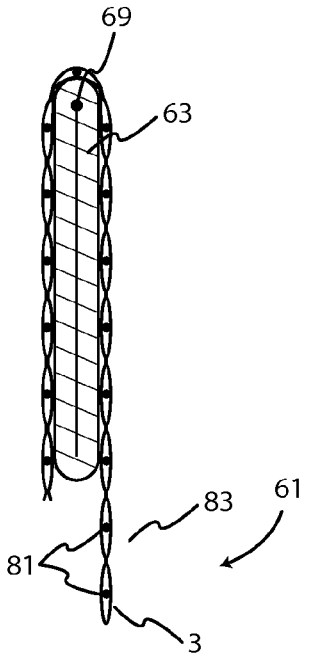
FIG. 9 is a sectional view taken on line 9-9 of FIG. 8.

FIGS. 7-9 show a second exemplary embodiment 40B of body 40 with FIG. 7 being a top plan view, partially cut away, of a tension member insert 20 including body 40B, FIG. 8 being an enlarged top plan view, partially cut away, of the area 8 of FIG. 7, and FIG. 9 being a sectional view taken on line 9-9 of FIG. 8.

Body 40B differs from body 40A as described below. Central section 61 comprises a fabric mesh 80 with holes 83. Mesh 80 comprises elongate, parallel, separated strands 81 of material, such as DuPont Kevlar, such as DuPont Kevlar K-29, that provides some tensile strength and with interweaving 82 to keep strands 81 spaced and provide structure. Interweaving 82 may be of the same or similar material as strands 81, but may be of other material and of lesser tensile strength. Mesh 80 has a front 84 and a rear 85.

Front and rear edge bands 63 are connected to front 84 and rear 85 of central section 61. In the exemplary embodiment, edge bands 63 are one inch wide, flattened tubes of DuPont Kevlar K-29 webbing connected to mesh 80 such as by folding an outer portion of mesh 80 over band 63 and attaching them such as by sewing. Many other attaching methods are well known in the art. Metal cables 69, are attached near front and rear edges 56, 58. Preferably, as seen in FIG. 9, cables 69 are woven into the outer edge of each band 63.

Figure 11:
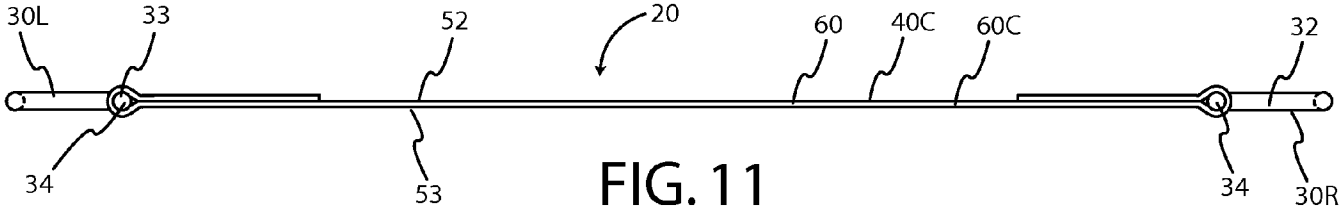
FIG. 11 is front elevation view of the insert of FIG. 10, the rear elevation view being a mirror image.
Figure 12:
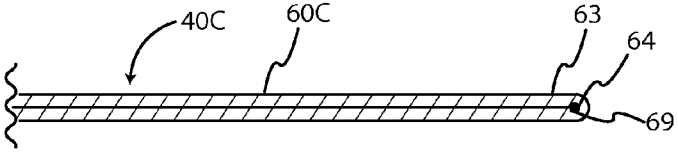
FIG. 12 is an enlarged sectional view taken on line 12-12 of FIG. 10.

FIGS. 10-12 show a third embodiment 40C of body 40 with FIG. 10 being a top plan view of a third embodiment of tension member insert 20, FIG. 11 being a front elevation view of tension member insert 20 of FIG. 10, the rear elevation view being a mirror image, and FIG. 12 being an enlarged sectional view taken on line 12-12 of FIG. 10. In the third embodiment 40C of body 40, fabric band 60 is a flattened tube 60C of material, such as Dupont Kevlar K-29. A width of 4.5 inches has been found to be functional. Protection component 68, such as metal cable 69, has been attached, such as by sewing or weaving, into the folds 63 of fabric tube 60 at the front and rear edges 56, 58.

Figure 13:
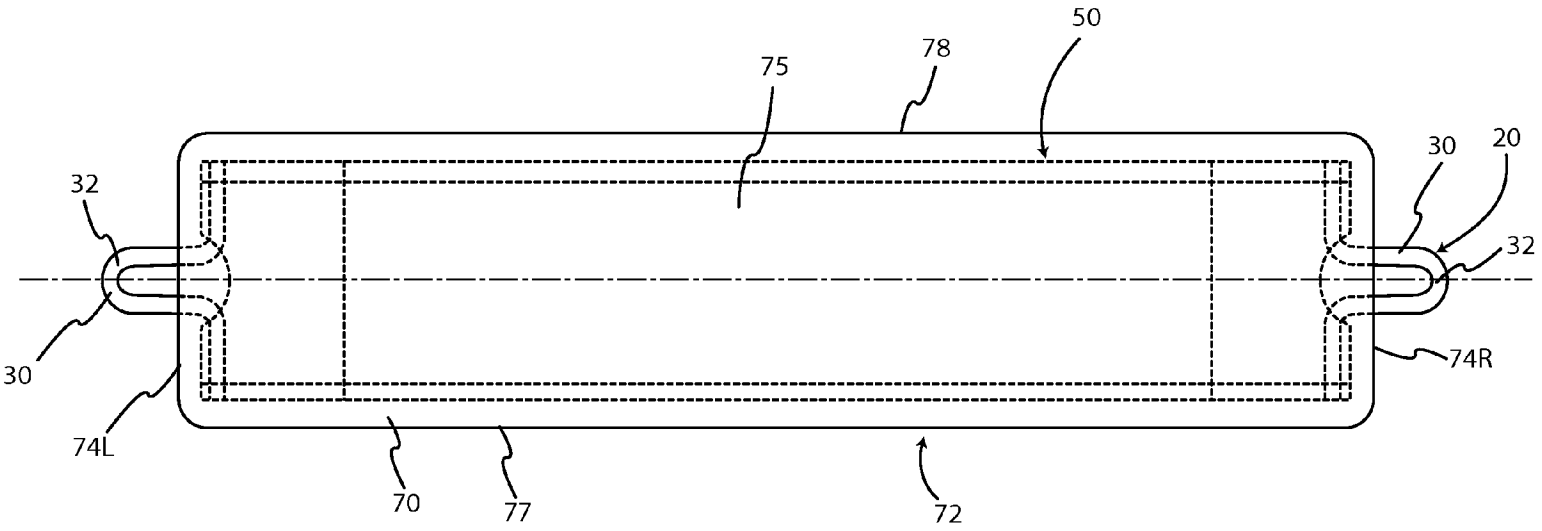
FIG. 13 is a top plan view of the seat including the resilient cover; the bottom plan view being a mirror image.
Figure 14:
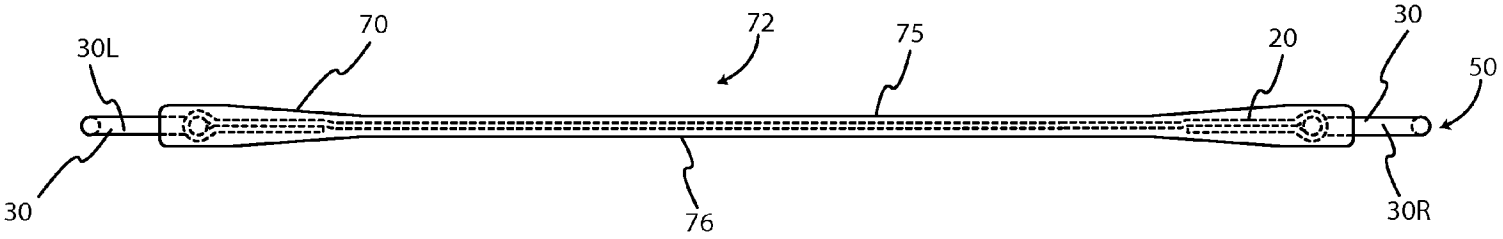
FIG. 14 is a front elevation view of the seat of FIG. 10, the rear elevation view being a mirror image.

FIG. 1 introduced the resilient cover 70 where it is shown in perspective view. FIGS. 13 and 14 are more directed to the resilient cover 70 and its shape and positioning relative to body 40. FIG. 13 is a top plan view of seat 10 including resilient cover 70; the bottom plan view, not shown, being a mirror image, and FIG. 14 is a front elevation view of seat 10 of FIG. 10, the rear elevation view being a mirror image. The portions of tension member 20 enclosed by cover 70, shown in broken lines, include all except the outer ends of bights 32 of connectors 30.

Cover 70 is made of resilient material, such as of rubber, that is adhered to tension member 20 by means well-known in the art. EPDM rubber (ethylene propylene diene monomer (M-class) rubber), a type of synthetic rubber, provides a good cover 70. EPDM rubber has outstanding heat, ozone, and weather resistance. Cover 70 protects body 40 from natural elements, wear, and vandals and hides the functional components of body 40. Seat 10 contains no stiff members and is very pliable so as to not cause serious damage should it strike a child.

Mesh 80 in central section 61 creates a more cohesive structure because the rubber of cover 70 disposed above mesh 80 of central section 61 and the rubber of cover 70 disposed below mesh 80 of central section 61 are connected by rubber disposed in holes 83 in mesh 80. In this manner, mesh 80 provides much stronger bonding of cover 70 to tension member 20 than is available with the adhesives of the traditional art.

Seat 10 resists the common form of vandalism of cutting into a face 77, 78 of cover 70 to tension component 50. A vandal's knife soon encounters metal cable 69, which blocks further inward cutting. If an edge portion of tension component 50 is exposed by vandalism, the shape and flexibility of the tension component will not pose a danger to users, unlike embedded sheet metal.

I claim:

1. A vandalism resistant swing seat for connecting to suspension elements and adapted to bend under the weight of an occupant or under it own weight comprising:

an elongate tension member comprising:

a body comprising:

a tension component comprising:

an elongate fabric band having:

a left end;
a right end;
a front edge; and
a rear edge; and a protection component comprising:

a front elongate metal cable attached near said front edge of said fabric band; and a rear elongate metal cable attached near said rear edge of said fabric band; and a left end connector including:

outer connection means for connection to a suspension element; and inner connection means connected to said left end of said fabric band; and a right end connector including:

outer connection means for connection to a suspension element; and inner connection means connected to said right end of said fabric band; and a resilient rubber cover covering said body; wherein:

said left end of said fabric band is connected to said left connector by folding over a portion of said connector and attaching to itself; and said right end of said fabric band is connected to said right connector by folding over a portion of said connector and attaching to itself.

2. The swing seat of claim 1 wherein:

said outer connection means of said left end connector protrudes from said cover; and said outer connection means of said right end connector protrudes from said cover.

* * * * *